United States Patent [19]

Brauer et al.

[11] 4,188,886

[45] Feb. 19, 1980

[54] PRESSURE PROBE FOR SAFETY-ARMING DEVICE

[75] Inventors: Larry F. Brauer; Jefferson O. Eaton, both of Ridgecrest, Calif.

[73] Assignee: The United States of America as represented by the Secretary of the Navy, Washington, D.C.

[21] Appl. No.: 910,544

[22] Filed: May 26, 1978

[51] Int. Cl.[2] ..... F42C 15/00

[52] U.S. Cl. ..... 102/223; 89/1 B

[58] Field of Search ..... 102/223-226, 102/228, 208, 258; 89/1.5 R, 1.5 F, 1 B

[56] References Cited

U.S. PATENT DOCUMENTS

| | | | |
|---|---|---|---|
| 1,883,583 | 10/1932 | Cole | 73/212 |
| 2,246,510 | 6/1941 | Diehl | 244/1 R |
| 3,382,805 | 5/1968 | Swaim | 102/228 |
| 3,643,508 | 2/1972 | Schneider | 73/344 |
| 3,670,656 | 6/1972 | Donahue et al. | 102/228 |
| 3,938,443 | 2/1976 | Wolski | 102/228 |
| 3,960,086 | 6/1976 | Fisher | 102/208 |
| 3,961,577 | 6/1976 | O'Steen | 102/226 X |
| 3,968,751 | 7/1976 | Palifka | 102/228 |
| 3,973,501 | 8/1976 | Briggs | 102/224 |
| 3,990,370 | 11/1976 | Campagnolo et al. | 102/208 |

*Primary Examiner*—David H. Brown

*Attorney, Agent, or Firm*—R. S. Sciascia; W. Thom Skeer

[57] ABSTRACT

An air pressure sensing probe for providing static-dynamic differential air pressure to operate a guided missile warhead safety-arming device is disclosed. The probe assembly is hermetically sealed to keep the device free of dirt and moisture during storage. An electrically initiated squib, fired at a predetermined time after missile launch, supplies gas pressure to the base of the probe which acts as a piston. The probe breaks a tip seal, extends laterally out from the missile, and wedges into the erect position. The base of the probe contacts a sliding punch which severs seals from two air pressure conduits and aligns air passageways with static and dynamic pressure ports in the probe. Differential air pressure is thus fed to a safety-arming device which utilizes pneumatic operation.

10 Claims, 5 Drawing Figures

PRESSURE PROBE FOR SAFETY-ARMING DEVICE

BACKGROUND OF THE INVENTION

1. Field of the Invention

The present invention pertains to air pressure sensing probes of the Pitot-Static tube type, and more particularly to such air pressure sensing probes which are inoperative until activated.

2. Description of the Prior Art

Prior erecting type air pressure probes have used stored mechanical energy such as preloaded springs to power probe erection. Other probe designs have used lanyards attached between the probe assembly and the missile launching apparatus to activate the probe after the missile has traveled a predetermined distance from the launcher. Some configurations have included external tear strips attached by a lanyard to the launching apparatus. These tear strips, when torn away, expose the probe mechanism which then activates. Actuation mechanisms using external hardware are useful in air launched missiles, but cannot be used in surface launched missiles where external structure would interfere with the launcher.

Typical prior art air pressure sensing probes are described, for example, in U.S. Pat. No. 3,382,805 to F. H. Swaim. Swaim illustrates an air scoop which is deployed in a rotary manner by a torsion spring. Another prior art device is described in U.S. Pat. No. 3,990,370 to Campagnuolo et al. This device uses an air scoop which is deployed by a lanyard attached between the scoop and launching platform. The scoop defines an internal passageway containing a turbine element which is subjected to slipstream flow as the scoop is deployed. Rotation of the turbine generates the electric current used to arm the ordnance device.

SUMMARY OF THE INVENTION

The present invention overcomes the limitations of the prior art in that no mechanical energy is stored in the probe erection mechanism prior to activation. The unit is hermetically sealed to prevent entrance of dirt or moisture which may degrade operation of the device after extended storage intervals.

A gas generating squib, initiated by launch of the missile to which the present invention is installed, causes pressure beneath the base of the extendable probe, forcing the probe through a seal and into the airstream. The erect probe lodges securely in place by means of a tapered shaft portion on its base which wedges into a tapered bore. As the probe approaches the fully erect position, the base of the probe contacts a punch forcing it upward and causing it to shear off seals on air passageways leading to a pneumatically operated safe and arm device within the missile. As the probe reaches the fully erect position, air passageways in the punch are aligned with air passageways in the base of the probe and the air pressure leading to the safe and arming device so that air flow continunity is established. Air pressure impinging upon an opening in the forward face of the probe causes dynamic pressure to be transmitted through the pressure probe to the safe and arming device. A static port on a sheltered side of the probe leads also to the safe and arming device where the differential pressure between static and dynamic pressure sensed by the probe causes operation of the safe and arming device.

The pressure differential between static and dynamic pressure is proportional to probe velocity. Therefore, the present invention enables design of a safe and arming device that only proceeds to arm after the probe and missile to which it is attached have obtained a predetermined velocity. This enhances safety of the missile system by preventing inadvertent arming while the device is not in a flight environment.

A pressure probe according to the present invention may be used to supply differential air pressure to a safe and arm device of the type described in assignee's copending patent application entitled "Safety and Arming Device/Contact Fuze" and described in Ser. No. 915,030, filed May 26, 1978.

BRIEF DESCRIPTION OF THE DRAWING

Further advantages of the present invention will emerge from a description which follows of the preferred embodiment of a pressure probe according to the invention given with reference to the accompanying drawing figures, in which.

DESCRIPTION OF THE PREFERRED EMBODIMENT

A pressure probe constructed according to the present invention is intended for use in a ordnance item such as a guided missile or free fall weapon where, for reasons of safety, arming of the weapon should not proceed in the absence of an actual aerodynamic environment, and until a preselected minimum safe separation distance between the ordnance item and launching vehicle has been achieved. The present invention is an air pressure sensing probe which erects from the side of an ordnance item after that item has been launched. Static and dynamic air pressure sensed by the probe may be utilized in a suitable pneumatically operated safe and arming device to arm the weapon only after a preselected pressure differential between static and dynamic pressure, corresponding to a minimum weapon velocity, has been obtained.

Figure 1:
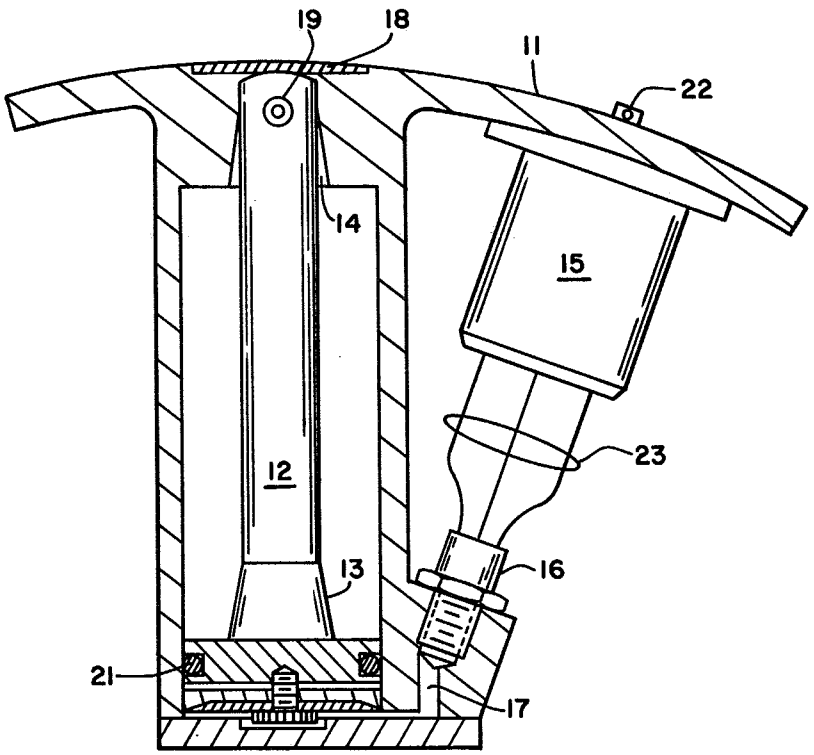
FIG. 1 illustrates a transverse sectional view of a pressure probe according to the invention.
Figure 5:
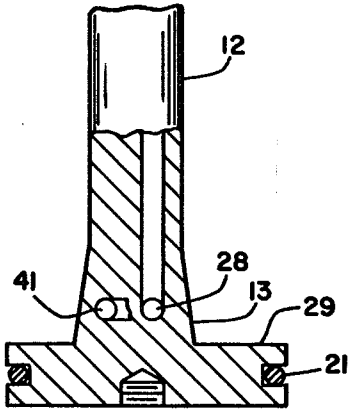
FIG. 5 illustrates in partial section the base configuration of a pressure probe according to the invention.

Referring now to the drawings, and in particular to FIG. 1, there is shown housing 11 which defines a curved surface corresponding to the exterior contour of the cylindrical ordnance item such as a guided missile, and an interior porion defining a chamber. Pressure sensing probe 12 having tapered base portion 13 is retained within the housing chamber by expanded base portion 29 which is sealed against housing 11 by seal 21. Tapered base portion 13 is contoured to tightly wedge into tapered aperture 14 during probe erection. This wedging action retains probe 12 in the fully erect extended position.

Hermetic probe seal 18 fastens to housing 11 to exclude dirt and moisture from the housing chamber during storage of this device prior to use to prevent corrosion of other degradation in system performance. Hermetic probe seal 18 is frangible and is penetrated by probe 12 during probe erection. Pressure duct 17 leads from electrically initiated squib 16 to the housing chamber beneath probe base 29. Probe erection switch 15, which may include a conductor leading from a source of electric power, controls initiation of squib 16.

Arming wire 22 extends between a launching vehicle, which could be an airplane, ship or submarine, to probe erection switch 15. Arming wire 22 engages a portion of probe erection switch 15 as shown in FIG. 1 to maintain switch 15 in the open position. Upon launch of the ordnance item, arming wire 22 is pulled from probe erection switch 15 by the launching vehicle. This permits probe erection switch 15 to close and send a firing pulse through firing leads 23 to electrically initiated squib 16. High pressure gas generated by squib passes through pressure duct 17 to the base of probe 12, and forces probe 12 through hermetic probe seal 18 until tapered base portion 13 wedges tightly into tapered aperture 14. At this time, dynamic port 19, located on the tip of probe 12, is exposed to the environment and begins to register dynamic fluid pressure.

Figure 2:
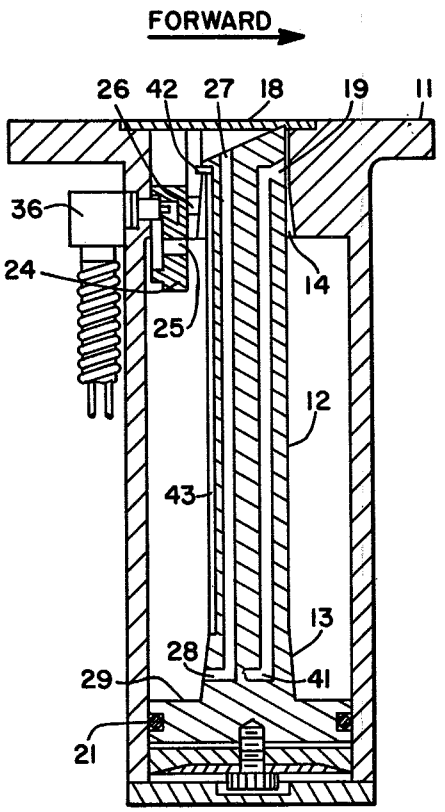
FIG. 2 illustrates a longitudinal sectional view of a pressure probe according to the invention.
Figure 3:
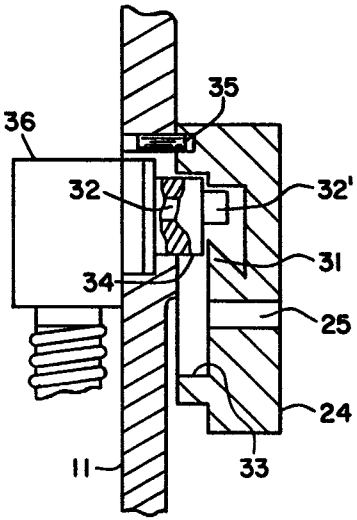
FIG. 3 illustrates details of a seal breaking punch according to the invention.

Referring now to FIGS. 2 and 3, it may be seen that dynamic pressure port 19 is ducted by dynamic pressure conduit 41 to the tapered portion of the base of the probe 12. Similarly, static pressure sensing port 27 is ducted to the tapered base portion of probe 12 by static pressure conduit 28.

Figure 4:
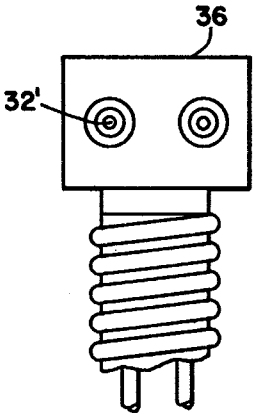
FIG. 4 illustrates an air pressure conduit assembly used with the invention.

A remotely located pneumatically operated safe and arming device connects with the present invention by means of tubes which are terminated by air pressure fitting 36. Fitting 36 includes interior tubing passageway 32 and exterior passageway seal 32'. Of course identical structure exists in tandum for handling fluid static and dynamic pressures, although in FIGS. 2 and 3 the mechanism for a single passageway connection is illustrated. FIG. 4 shows the tandum arrangement of fitting 36.

As squib 12 erects in response to gas pressure from squib 16, base portion 29 of probe 12 contacts the lower surface of guillotine punch 24 causing pin 35 to shear and permit punch 24 to move upward under the urging of base 29. As base 29 forces punch 24 upward, chisel 31 engages and severs exterior passageway seal 32'. Punch 24 continues upward until connecting passageway 25 aligns between interior tubing passageway 32 and orfice 26. Punch 24 is stopped at this position by punch surface 33 which contacts fitting surface 34. As tapered portion 13 wedges into tapered aperture 14, static pressure conduit 28 at tapered base portion 13 also aligns with orifice 26, producing a continuous static pressure path between sensing port 27 and a remote pneumatic operator. Of course, the same mechanism in tandum connects dynamic pressure port 19 with the remote operator simultaneously.

In order to maintain static pressure conduit 28 and dynamic pressure conduit 41 at tapered base portion 13 in alignment with orifice 26 and a tandum orifice for dynamic pressure conduit 41, guide pin 42, installed in housing 11, fits into dorsal keyway 43. As probe 12 erects, guide pin 42 prevents rotation and resultant misalignment of static and dynamic pressure conduits with respective orifices.

Although the perferred embodiment has been described, it will be understood that within the purview of this invention various changes may be made in the form, details, proportion and arrangement of parts, the combination thereof and mode of operation, which generally stated results in a device capable of carrying out the features set forth as disclosed and defined in the appended claims.

What is claimed is:

1. An erectable pressure probe for sensing static and dynamic pressure in a fluid, comprising:

a housing having an opening;

a probe having a tip and a base, said base being slidably retained within said housing, said tip being extensible through said opening, and said probe having conduit means for separately transmitting fluid static and dynamic pressure from said tip to said base;

probe erection means attached to said housing and responsive to an external signal for extending said tip through said opening to define an extended tip; and fluid pressure distribution means positioned to cooperate with said base and extended tip for conducting static and dynamic fluid pressure from said tip through said conduit means to a remote operator.

2. An erectable pressure probe as set forth in claim 1 wherein said opening is a sealable opening and said base is sealingly slidable between retracted and extended positions.

3. An erectable pressure probe as set forth in claim 2 wherein said base being in said extended position corresponds to said tip being extended through said sealable opening, and when said base is in said retracted position, said tip is retracted within said housing, and a frangible seal closes said sealable opening.

4. An erectable pressure probe as set forth in claim 2 wherein aforesaid probe erection means comprises a gas generating squib attached to aforesaid housing and positioned to pressurize said housing and said sealingly slidable probe base.

5. An erectable probe as set forth in claim 4 wherein said probe erection means further comprises:

said gas generating squib being electrically initiatable;

a source of electric energy;

an arming wire; and an electric switch releasably retaining said arming wire and operative in response to release of said arming wire, said switch being electrically connected between said source of electric energy and said electrically initiatable gas generating squib;

whereby release of said arming wire from said switch causes said switch to close and supply electric energy to said gas generating squib, initiating said squib.

6. An erectable pressure probe as set forth in claim 2 wherein aforesaid fluid pressure distribution means includes:

static and dynamic pressure output ports each configured to receive and retain a sealed pressure conducting tube leading from said remote operator; and guillotine punch means cooperating with said base and slidably retained to aforesaid housing for severing a seal on said sealed pressure conducting tubes in response to said base moving from said retracted position to said extended position.

7. An erectable pressure probe as set forth in claim 6 wherein said guillotine punch means is releasably retained in an initial position by a shearable pin.

8. An erectable pressure probe as set forth in claim 2 wherein said probe base includes a tapered portion, and said housing includes a corresponding tapered aperture aligned with and adjacent to said sealable opening for receiving and retaining said tapered portion of said base in said extended position.

9. An erectable pressure probe as set forth in claim 8 wherein said probe has a dorsal keyway extending from a point adjacent said tip to a point adjacent said tapered base portion, and said housing has a pin extending from said housing adjacent said sealable opening and engaging said dorsal keyway for guiding said probe from said retracted position to said extended position.

10. An erectable pressure probe as set forth in claim 8 wherein said conduit means exits said probe through said tapered portion of said probe base.

* * * * *